US008555969B2

(12) United States Patent
Goodwin et al.

(10) Patent No.: US 8,555,969 B2
(45) Date of Patent: Oct. 15, 2013

(54) METHODS AND APPARATUS TO CHANGE THE MOBILITY OF FORMATION FLUIDS USING THERMAL AND NON-THERMAL STIMULATION

(75) Inventors: Anthony Robert Holmes Goodwin, Sugar Land, TX (US); Tim Jones, Cottenham (GB); Keith James Massie, Aberdeen (GB); John Nighswander, Katy, TX (US); Gary Tustin, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 511 days.

(21) Appl. No.: 12/682,289

(22) PCT Filed: Sep. 22, 2008

(86) PCT No.: PCT/US2008/077219

§ 371 (c)(1),
(2), (4) Date: Aug. 13, 2010

(87) PCT Pub. No.: WO2009/051936

PCT Pub. Date: Apr. 23, 2009

(65) Prior Publication Data

US 2010/0294493 A1 Nov. 25, 2010

Related U.S. Application Data

(60) Provisional application No. 60/979,694, filed on Oct. 12, 2007.

(51) Int. Cl.

| | |
|---|---|
| ***E21B 47/00*** | (2012.01) |
| ***E21B 49/08*** | (2006.01) |
| ***E21B 36/00*** | (2006.01) |

(52) U.S. Cl.
USPC ..... 166/264; 166/57; 166/302

(58) Field of Classification Search
None
See application file for complete search history.

(56) References Cited

U.S. PATENT DOCUMENTS

| | | | | |
|---|---|---|---|---|
| 2,580,766 A | | 1/1952 | Hall | |
| 2,680,486 A | * | 6/1954 | Carpenter | 166/297 |
| 4,004,636 A | | 1/1977 | Brown et al. | |

(Continued)

FOREIGN PATENT DOCUMENTS

| | | |
|---|---|---|
| GB | 2430218 | 3/2007 |

OTHER PUBLICATIONS

Vogel, H. "The Law of the Relation Between the Viscosity of Liquids and the Temperature", Physikalische Zeitschrift, 1921, vol. 22; pp. 645-646.

(Continued)

*Primary Examiner* — Angela M DiTrani
(74) *Attorney, Agent, or Firm* — John Vereb

(57) ABSTRACT

Methods and apparatus that change the mobility of formation fluids using thermal and non-thermal stimulation including, an example apparatus to simultaneously provide thermal and non-thermal stimulation to change a mobility of a fluid in a subsurface formation includes one or more containers to hold one or more reactants. Additionally, the example apparatus includes a reactor to initiate a chemical reaction with at least one of the reactants. Further, the example apparatus includes an injector to inject a product of the chemical reaction into a formation. The product of the chemical reaction includes heat and a gaseous diluent to change a mobility of a fluid in a subsurface formation.

12 Claims, 6 Drawing Sheets

(56) References Cited

U.S. PATENT DOCUMENTS

| | | | | |
|---|---|---|---|---|
| 4,546,829 | A * | 10/1985 | Martin et al. | 166/267 |
| 5,692,565 | A | 12/1997 | MacDougall et al. | |
| 7,347,262 | B2 | 3/2008 | Tarvin et al. | |
| 7,464,755 | B2 | 12/2008 | Edwards | |
| 7,614,294 | B2 | 11/2009 | Hegeman et al. | |
| 7,717,172 | B2 | 5/2010 | Sonne et al. | |
| 7,748,265 | B2 | 7/2010 | Goodwin et al. | |
| 7,878,243 | B2 | 2/2011 | Goodwin et al. | |
| 2006/0137873 | A1 * | 6/2006 | Caudwell et al. | 166/252.5 |
| 2007/0137858 | A1 | 6/2007 | Considine et al. | |
| 2008/0066535 | A1 | 3/2008 | Vasques et al. | |
| 2008/0066536 | A1 | 3/2008 | Goodwin et al. | |
| 2008/0066904 | A1 * | 3/2008 | Van Hal et al. | 166/250.1 |
| 2008/0078581 | A1 | 4/2008 | Goodwin et al. | |
| 2009/0008079 | A1 | 1/2009 | Zazovsky et al. | |
| 2010/0186948 | A1 | 7/2010 | Sonne et al. | |
| 2010/0223989 | A1 | 9/2010 | Reid et al. | |

OTHER PUBLICATIONS

Bell, T. N., Cussler, Jr., E. L., Harris, K. R., Pepela, C. N., and Dunlop, P. J., "An Apparatus for Degassing Liquids by Vacuum Sublimation", Journal of Physical Chemistry, Dec. 1968, ol. 72(13): pp. 4693.

Quail, B., Hill, G. A., and Jha, K. N., "Correlations of Viscosity, Gas Solubility, and Density for Saskatchewan Heavy Oils", Industrial & Engineering Chemistry Research, Mar. 1988, vol. 27(3); pp. 519-523.

Kokal, S. L. and Sayegh, S. G., "Phase Behaviour Correlation of $CO^2$/Heavy Oil Mxues for Enhanced Oil Recovery", Fluid Phase Equilibria, Dec. 1989, pp. 283-290.

Mehrotra, A. K., Nighswander, J. A., and Kalogerakis, N., "Data and Correlation for CO2-Peace River Bitumen Phase Behaviour at 22-200°", AOSTRA Journal of Research, 1989, vol. 5(4); pp. 351-358.

Chase, M., "NIST-JANAF Thermochemical Tables, Fourth Edition," Journal of Physical and Chemical Reference Data Monographs & Supplements, 1989, American Institute of Physics, Melville, NY USA.

Barin, I., Sauert, F., Schultz-Rhonhof, E., and Sheng, W. S., Thermochemical Data of Pure Substances, Parts I and II, 1989, Wiley-VCH, Weinheim, Germany.

Lillico, D. A., Babchin, A. J., Jossy, W. E., Sawatzky, R. P., Yuan J.-Y., "Gas Bubble Nucleation Kinetics in a Live Heavy Oil", Colloids and Surfaces A: Physicochemical and Engineering Aspects, Nov. 2001, vol. 192(1); pp. 25-38.

Coniglio, L., Rauzy, E., Péneloux, A., and Neau, E., "Use of Heat Capacities for the Estimation of Cubic Equation-of-State Parameters—Application to the Prediction of Very Low Vapor Pressures of Heavy Hydrocarbons", Fluid Phase Equilibria, Aug. 2002, vol. 200(2); pp. 275-398.

George, D. S., Hayat, O., and Kovscek, A. R. "A Microvisual Study of Solution-Gas-Drive Mechanisms in Viscous Oils", Journal of Petroleum Science and Engineering, Feb. 2005, vol. 46(1-2); pp. 101-119.

Kaye and Laby, "Standard Thermodynamic Functions for Pure Inorganic Substances, for Aqueous Ions, and for Pure Organic Substances", National Physical Laboratory, 2005, URL: <http://www.kayelaby.npl.co.uk/chemistry/3_10/3_10_5. html>.

Chen, Z., "Heavy Oils, Part I", SIAM News, Apr. 2006, vol. 39(3): pp. 1-3.

Chen, Z., "Heavy Oils, Part II", SIAM News, May 2006, vol. 39(4): pp. 1-4.

Shigemoto, N., Al-Maamari, R. S., Jibril, B. Y. and Hirayama, A., "A Study of the Effect of Gas Condensate on the Viscosity and Storage Stability of Omani Heavy Crude Oils", Energy & Fuels, Nov. 2006, vol. 20(6); pp. 2504-2508.

Goodvvin, A. R. H., Hegeman, P., Reid, Jr., L., Nold, R., "SLB White Paper: Sampling Heavy Oil and Bitumen", 2007.

Goodwin, A. R. H., Marsh, K. N., Peters, C. J., "Solubility and the Oil Industry", in Developments and Applications of Solubility for the International Union of Pure and Applied Chemistry, Elsevier Science, Editor T. J. Letcher (Royal Society of Chemistry, 2007), IUPAC Project No. 2005-016-1-100.

CIPO Office Action of Canadian Application No. 2,702,495 dated Oct. 24, 2011; pp. 1-2.

Shigemoto, N.; Al-Maamari, R. S.; Jibril, B. Y.; Hirayama, A. Energy Fuel 2006, 20, 2504-2508.

* cited by examiner

METHODS AND APPARATUS TO CHANGE THE MOBILITY OF FORMATION FLUIDS USING THERMAL AND NON-THERMAL STIMULATION

FIELD OF THE DISCLOSURE

This disclosure relates generally to changing the mobility of formation fluids and, more specifically, to changing the mobility of formation fluids using both thermal and non-thermal stimulation.

BACKGROUND

As global reserves of light crude oil diminish, the exploration for and production of heavy oil and bitumen becomes of increased importance to maintain a stable global supply of hydrocarbon. When evaluating heavy oil or bitumen formations, it is advantageous to obtain representative samples of the formation to determine appropriate drilling and production methods. However, due to the mobility of heavy oil and bitumen, sampling these formations can be difficult or impossible using many known light crude oil sampling techniques.

Attempting to sample a heavy oil or bitumen, for example, without first increasing the mobility of these fluids can result in excessive drawdown pressures, which can cause failure of a pump or pumpout unit being used to extract the fluid, failure (e.g., cracking, fracturing and/or collapse) of the formation, and/or phase changes and, thus, compositional changes to the fluid being sampled. Further, such excessive drawdown pressures can lead to the production of sand, which may cause failure of sampling tool seals. While increasing the areas of the sampling ports or probes can reduce the drawdown pressures, larger port or probe areas can be difficult to achieve without adversely impacting the size of the sampling tool and the ability to achieve an effective seal around the sampling ports or probes.

One factor contributing to the low mobility of heavy oil and bitumen formation is the high viscosity of these fluids. As illustrated by Equation 1 below, a flow-rate of fluid from a subsurface formation may be changed by increasing a pressure difference, changing the permeability of the formation or by decreasing the viscosity of the formation fluid. The pressure difference applied by the sampling tool to withdraw the fluid is represented by $\Delta p$, the fluid viscosity is represented by $\eta$ and the permeability of the formation is represented by k.

$$Q \propto \Delta p \cdot k/\eta \qquad \text{Equation 1}$$

Substantially reducing the viscosity of the heavy oil and bitumen in a formation can increase mobility sufficiently to obtain a sample. However, to be helpful in determining a production strategy, the fluid sample has to be representative of the formation fluid and/or any changes to the characteristics of the fluid sample have to be reversible.

Some known methods to increase the mobility of formation fluids involve heating the formation through a variety of means (e.g., thermal stimulation), or injecting a diluent into the formation (e.g., non-thermal stimulation). The diluent or solvent is usually miscible with the formation fluid, and in these cases, the diluent may be referred to as a solvent. However, steam or water may not be readily miscible diluents. Production methods that rely on injecting a suitable solvent into a formation include vapor assisted extraction (VAPEX). Another primary production method is cold heavy oil production with sand (CHOPS) that relies on reducing the pressure and evolving the gas from the formation to produce a foam. Some example methods of heating a formation include cyclic steam circulation, steam floods, and steam assisted gravity drainage (SAGD). While the use of some diluents may be appropriate for certain applications such as, for example, production in which the chemical composition and/or the physical properties of the formation fluid need not be maintained, these diluents may not be appropriate to obtain samples of formation fluid because they irreversibly change the formation fluid.

While the above-mentioned methods may be used to change the mobility of a formation fluid, in some circumstances, the mobility of the formation fluid is not sufficiently increased by either heating the formation fluid or injecting a diluent into the formation fluid.

SUMMARY

In accordance with a disclosed example, an example apparatus to simultaneously provide thermal and non-thermal stimulation to change a mobility of a fluid in a subsurface formation. The apparatus includes one or more containers to hold one or more reactants. Additionally, the apparatus includes a reactor to initiate a chemical reaction with at least one of the reactants. Further, the apparatus includes an injector to inject a product of the chemical reaction into a formation. The product of the chemical reaction comprises heat and a gaseous diluent to change a mobility of a formation fluid. Still further, the apparatus includes a controller to control at least one of the reactor, or the injector.

In accordance with another disclosed example, an example method to simultaneously provide thermal and non-thermal stimulation to change a mobility of a fluid in a subsurface formation. The method includes initiating a chemical reaction with one or more chemicals. A product of the chemical reaction comprises heat and a gaseous diluent. Additionally, the method includes exposing the product of the chemical reaction to the formation to change the mobility of the formation fluid.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

Figure 1:
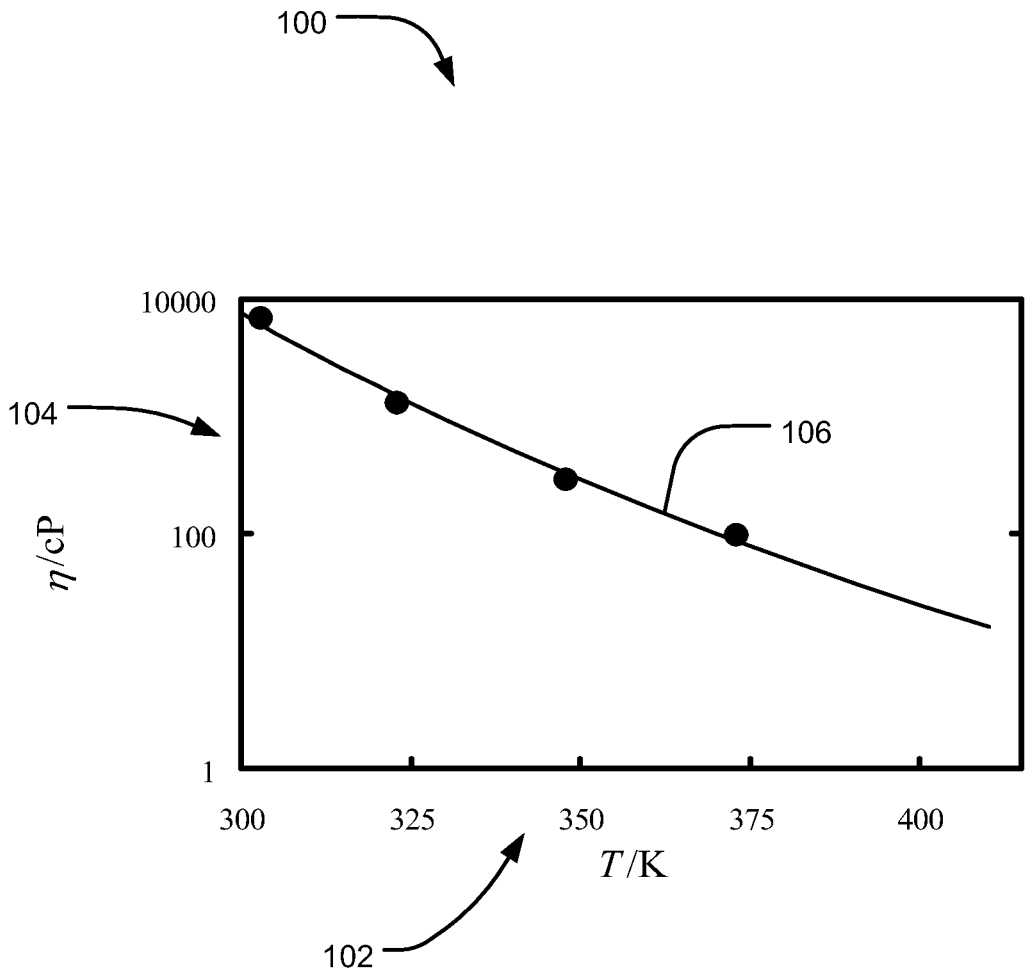
FIG. 1 (PRIOR ART)
FIG. 1 depicts a graph that illustrates a known relationship between a viscosity of a formation fluid and a temperature of a formation fluid.

FIG. 1 is a graph 100 that is representative of testing done on an Oman crude oil (e.g., the Mukhaizna formation) at temperatures ranging between 30° C. and 100° C. as described in Shigemoto et. al., *Energy Fuels* 2006, 20, 2504-2508. The graph 100 includes an abscissa 102 and an ordinate 104. The abscissa 102 illustrates the temperature at which the formation fluid sample was tested and the ordinate 104 is representative of the kinematic viscosity of the formation fluid sample. The measured data is illustrated by a curve 106 and may be represented by Equation 2 below, where the formation fluid viscosity $\eta$ is represented as a function of temperature t, and a coefficient a=6871.682 $K^{-1}$ and a coefficient b=−13.9693. The functional form of equation 2 was recommended by Vogel, *The law of the relation between the viscosity of liquids and the temperature Physik Z.* 1921, 22, 645-646. The curve 106 illustrates that increasing the temperature 100° C. above the reservoir temperature reduces the viscosity by a factor of approximately 100.

$$\eta/\text{cP} = \exp\left\{\frac{a}{(T/\text{K})} + b\right\} \qquad \text{Equation 2}$$

As described in Quail et al., *Ind. Eng. Chem. Res.* 1988, 27, 519-523, the solubility, viscosity and density of 59 heavy crude oil samples taken from Saskatchewan, Canada were expressed as a function of the concentration of carbon dioxide at temperatures between 293K and 413K at pressures ranging between 0.1 MPa and 14 MPa. The results of these measurements indicated that the viscosity of the formation fluid decreased at a substantially constant temperature with increasing carbon dioxide concentration within the formation fluid.

A mobility of formation fluid may be changed by non-thermal stimulation or thermal stimulation. To change the mobility of a formation fluid using non-thermal stimulation involves injecting into a formation fluid a diluent or solvent that may or may not be miscible with the formation fluid and which increases the mobility of the formation fluid by decreasing its viscosity. Examples of non-thermal stimulation have been described in Kokal et al., S. G. *Phase Behavior Correlation of $CO_2$/Heavy Oil Mixtures For Enhanced Oil Recovery. Fluid Phase Equilib.* 1989, 52, 283-290 and Mehrotra, et al., *Data and correlation for $CO_2$-Peace River Bitumen Phase Behaviour at* 22-200 C. AOSTRA J. Res. 1989, 5, 351-358. These materials describe decreasing the viscosity of the formation fluid by a factor of approximately 60 by injecting carbon dioxide into a formation fluid up to its solubility limit. For example, the viscosity of a formation fluid having a viscosity of approximately 2000 cP at reservoir conditions (e.g., down-hole conditions) can be decreased to about 30 cP. To decrease the viscosity of 1 liter (L) of formation fluid in this manner requires about 2 liters of carbon dioxide at a pressure of approximately 20 kpsi to be injected into the formation. Alternatively, natural gas and/or mixtures of nitrogen and carbon dioxide may be injected into a formation to reduce the viscosity of a formation fluid. However, the decrease in viscosity may be less compared to the example above involving the injection of carbon dioxide.

Another example of non-thermal stimulation involves injecting hydrogen into a formation. Such a process has been recognized by the Shell Oil Company, which has sponsored measurements of phase equilibira of hydrogen with heavy oil components at the Delft University of Technology. Hydrogen is relatively soluble in hydrocarbons (e.g., formation fluid) and, if injected into a formation fluid, may be later removed using a process called vacuum sublimation. However, if hydrogen is injected into a formation fluid at an elevated temperature, a reaction (e.g., hydrothermolysis) may occur that causes an irreversible alteration of the chemical composition of the fluid sample, which is not desirable when obtaining a formation fluid sample. To substantially prevent this type of reaction from occurring between the hydrogen and the formation fluid, the temperature at which the hydrogen is exposed to the formation fluid may be controlled.

Figure 2:
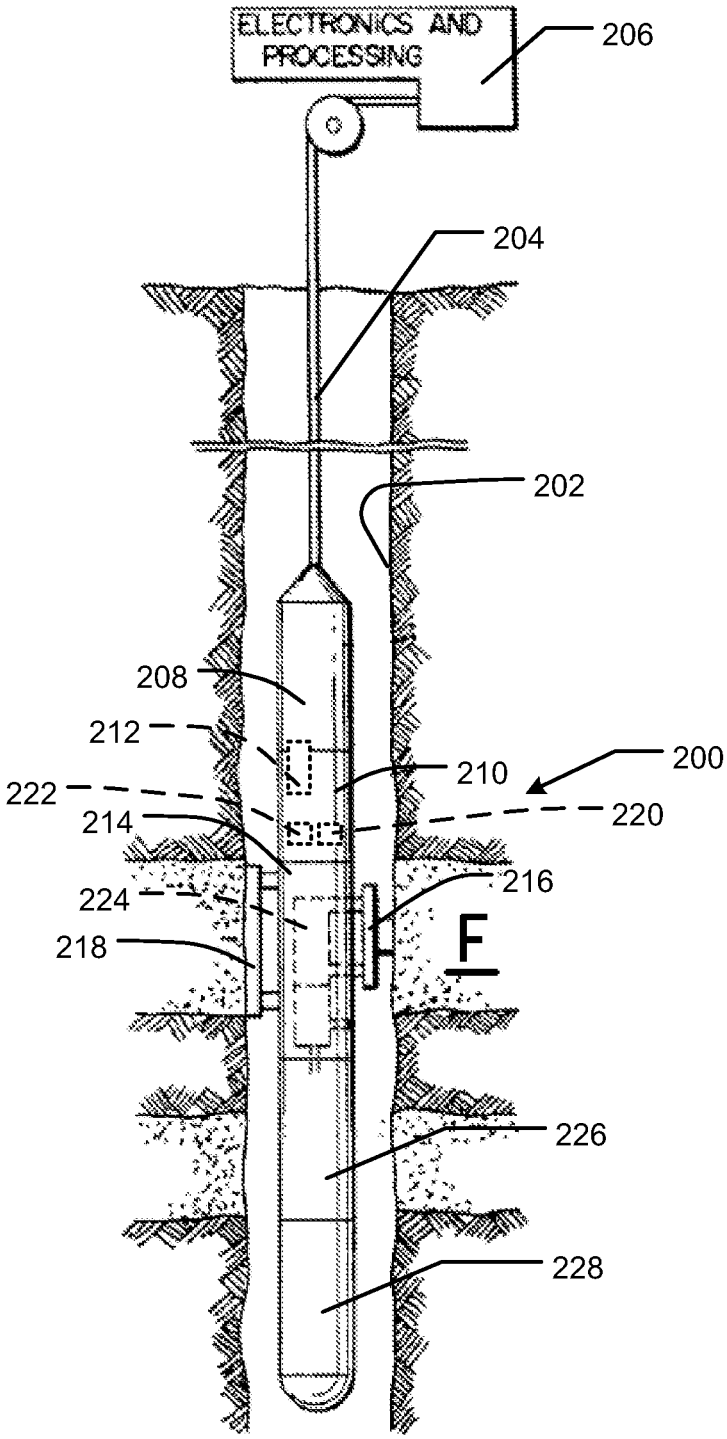
FIG. 2 depicts an example wireline tool that may be used to change the mobility of a formation fluid and to extract and analyze formation fluid samples.

Turning to FIG. 2, an example wireline tool 200 that may be used to change the mobility of a formation fluid and to extract and analyze formation fluid samples is shown. The example wireline tool 200 is suspended in a wellbore 202 from the lower end of a multiconductor cable 204 that is spooled on a winch (not shown) at the Earth's surface. At the surface, the cable 204 is communicatively coupled to an electronics and processing system 206. The example wireline tool 200 includes an elongated body 208 that includes a module 210 having a downhole control system 212 configured to control the initiation of a chemical reaction, the injection of the reactants and/or the product of a chemical reaction into a formation F, and/or extraction of formation fluid from the formation F.

The example wireline tool 200 also includes a formation tester 214 having a selectively extendable probe assembly 216 and a selectively extendable tool anchoring member 218 that are arranged on opposite sides of the elongated body 208. The extendable probe assembly 216 is configured to selectively seal off or isolate selected portions of the wall of the wellbore 202 to fluidly couple to the adjacent formation F, to inject reactant(s) and/or the product of a chemical reaction into the formation F and/or to draw fluid samples from the formation F. The example wireline tool 200 may be provided with one or more reactant chambers 220 and 222 to retain the reactant(s) prior to being mixed, injected and/or exposed to the formation F. The extendable probe assembly 216 may be provided with a sampling probe 304 (FIG. 3) that is to be held against the wall of the wellbore 202 to draw formation fluid into the wireline tool 200 (e.g., the formation tester 214). The formation tester 214 also includes a fluid analysis module 224 through which the obtained fluid samples flow. The fluid may thereafter be expelled through a port (not shown) or it may be sent to one or more fluid collecting chambers 226 and 228. In the illustrated example, the electronics and processing system 206 and/or the downhole control system 212 are configured to control the extendable probe assembly 216, the initiation of mixing the reactants, the initiation of a chemical reaction, the injection of the reactants and/or the product of the chemical reaction into the formation F, and/or the drawing of a fluid sample from the formation F.

In some examples, the example wireline tool 200 may analyze the quantity of asphaltenes within the formation fluid. In practice, the viscosity of a formation fluid is associated with the quantity and type of asphaltenes within the formation fluid. High asphaltene content within the formation fluid may be associated with an increased viscosity of the formation fluid and, therefore, understanding the chemical structure of asphaltenes and the mole fraction can facilitate the development of different production and/or sampling strategies.

Figure 3:
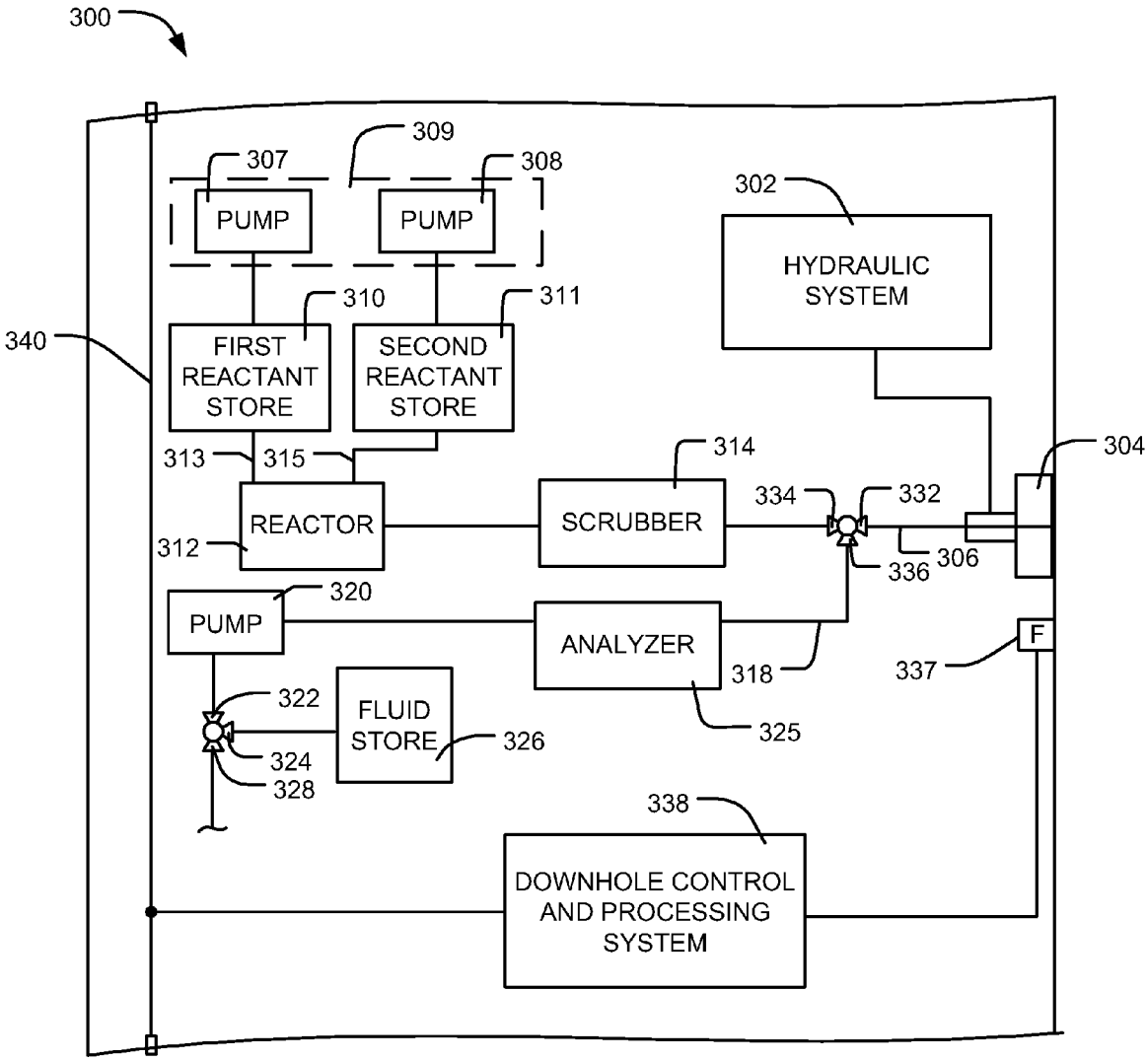
FIG. 3 depicts a block diagram of an example apparatus that may be used to implement a formation tester of the example wireline tool of FIG. 2 to change the mobility of a formation fluid and to extract and analyze formation fluid samples.

FIG. 3 depicts a block diagram of an example apparatus 300 that may be used to implement the example formation tester 214 of FIG. 2. In the illustrated example of FIG. 3, lines shown connecting blocks represent fluid and/or electrical connections that may include one or more flowlines (e.g., hydraulic flowlines or formation fluid flowlines) or one or more wires or conductive paths. As shown in FIG. 3, the example apparatus 300 includes a hydraulic system 302 that may be fluidly coupled to the sampling probe 304 to extend the sampling probe 304 into engagement with the formation F (FIG. 2) to enable injecting reactants and/or a product of a chemical reaction into the formation F (FIG. 2) and/or drawing of a fluid sample from the formation F (FIG. 2).

To inject chemical reactants and/or the product of a chemical reaction into the formation F (FIG. 2) through a sample flowline 306, the example apparatus 300 is provided with a first pump 307 and a second pump 308 that form an injector 309. In particular, the first pump 307 and/or the second pump 308 may be implemented with piston pumps used to move the one or more reactants from a first reactant store 310 and/or a second reactant store 311 through flowlines 313 and 315, a reactor 312, and a scrubber 314. Additionally, to draw formation fluid (e.g., from the formation F) through the sample flowline 306 and a sample flowline 318, the example apparatus 300 is provided with a third pump 320 (e.g. a reciprocating pump). In particular, the third pump 320 draws or pumps formation fluid through the flowlines 306 and 318, a fluid analyzer 325 and a valve 322, which has a first selectable outlet 324 that is fluidly coupled to a fluid store 326 and a second selectable outlet 328 that expels fluid out of the formation tester 214 (FIG. 2) into, for example, the wellbore 202 of FIG. 2. Although in this example the injector 309 is positioned upstream relative to the first and second reactant stores 310 and 311, in other example implementations, the injector 309 may be in any other suitable position. Additionally, in other example implementations, the injector 309 may include an additional pump(s) (not shown) that may be adjacent the first and second pumps 307 and 308 or positioned in any other suitable location such as, for example, between the reactor 312 and the scrubber 314 or between the scrubber 314 and the sampling probe 304.

The first reactant store 310 and/or the second reactant store 311 may be provided with a plurality of chambers (not shown), which are to hold reactant(s) that are to be used in a chemical reaction such as, an exothermic reaction (i.e., a chemical reaction that releases heat). In other examples, the plurality of chambers are to hold reactants that are mixed (e.g., to form a mixture) prior to the wireline tool 200 (FIG. 2) being lowered into the wellbore 202 (FIG. 2). In this example, to initiate a chemical reaction, the mixture is exposed to a catalyst such as one of the catalysts described below. The reactants may be any suitable reactants including, for example, hydrogen peroxide, water, methanol, tertiary butyl carboxylic acid, tertiary butyl peroxide, ethanol, carbohydrates such as sugar, carbonated substances and/or any other water soluble compound that comprises at least carbon and hydrogen. In some examples, at least one of the reactants is an oxidizing agent such as, for example, hydrogen peroxide, tertiary butyl peroxide or tertiary butyl carboxylic acid. In other examples, at least one of the reactants may provide a fuel source such as, for example, a tertiary butyl carboxylic acid, tertiary butyl peroxide, methanol, ethanol, sugar, a carbonated substance or any other water soluble compound that comprises at least carbon and hydrogen.

Each of the chambers of the first reactant store 310 and/or the second reactant store 311 are to be filled with their respective reactant prior to the wireline tool 200 (FIG. 2) being lowered into the wellbore 202 (FIG. 2). However, the chambers of the first reactant store 310 and/or the second reactant store 311 may be filled and/or refilled using any other suitable method. In some examples, at least part of each of the reactants in each of the different chambers is used in a first chemical reaction. Alternatively, in some examples, at least a part of some of the reactants are used in the first chemical reaction and at least a part of different reactants are used in a second chemical reaction. Any suitable number of chambers (e.g., 1, 2, 3, 4, 5, etc.) may be used to hold the same or different reactants.

The reactor 312 receives from the first reactant store 310 and/or the second reactant store 311 the one or more reactants used in the chemical reaction. The reactor 312 may combine (e.g., mix) two or more reactants to initiate the chemical reaction. Alternatively, the reactor 312 may initiate a chemical reaction in which a single reactant decomposes. The reactor 312 may be provided with any suitable catalyst such as, for example, a platinum metal dispersed on a substrate of aluminum oxide, manganese dioxide, titanium oxide or silica, that changes the rate at which the chemical reaction occurs. The catalyst may be in any suitable arrangement such as, for example, a grill arrangement, a lattice arrangement, a packed bed arrangement or a filter pack arrangement to promote the exposure of the reactant(s) to the catalyst and/or accelerate the rate at which the chemical reaction occurs. In some examples, the product of the exothermic chemical reaction is only heat and a gaseous diluent (e.g. gaseous solvent). In other examples, the product of the exothermic chemical reaction includes at least heat and a gaseous diluent (e.g., gaseous solvent). The gaseous diluent may be dissolvable and/or miscible in a formation fluid and the gaseous diluent may be soluble within the formation fluid to cause a change in a viscosity of the formation fluid. Specifically, the gaseous diluent may be a solvent that at least partially dilutes the formation fluid by admixture. Additionally, the gaseous diluent may be able to migrate and/or diffuse within the formation fluid relatively quickly. Further, in some examples, exposing the formation fluid to the product of the chemical reaction does not substantially alter the formation fluid and/or change a chemical composition of the formation fluid.

Exposing a formation fluid to the product of the chemical reaction may decrease the viscosity of the formation fluid. For example, exposing the formation fluid to heat decreases the viscosity of the formation fluid, as shown, for example, in FIG. 1. Additionally, mixing a gaseous diluent with a formation fluid also decreases the viscosity of the formation fluid. However, if both heat and a gaseous diluent are substantially simultaneously exposed to a formation fluid, the reduction in viscosity of the formation fluid is surprisingly about 1.5 times greater than if only heat or a gaseous diluent alone were exposed to the formation fluid. As illustrated in Equations 3 through 12 below, the gaseous diluent may be, for example, carbon monoxide (CO), carbon dioxide ($CO_2$), oxygen ($O_2$), and/or hydrogen ($H_2$). However, in other examples, any other suitable element and/or component providing a chemical reaction that produces a product (e.g., heat and a gaseous dilutent) that is preferably dissolvable and/or miscible in a formation fluid and which is associated with increasing the mobility and/or decreasing the viscosity of a formation fluid may be used. As discussed in more detail below, at least part of the product of the chemical reaction is to be injected and/or exposed to the fluid in the subsurface formation and at least some of the components and/or elements (e.g., hydrogen (i.e., $H_2$), carbon dioxide (i.e., $CO_2$), and/or nitrogen (i.e., $N_2$)) may at least partially dissolve within the formation fluid.

As illustrated in Equations 3 through 12 below, another product of the reaction also includes steam or water. While gaseous solvents are dissolvable within a formation fluid, water ($H_2O$) or steam and/or hot acid typically are not readily dissolvable within formation fluid. Water or steam may form foam and/or an emulsion in the formation fluid, which, depending on the water concentration within the formation fluid, may also reduce the viscosity of the formation fluid. However, steam may alter some characteristics of the formation fluid and, thus, steam may not be appropriate to obtain samples of formation fluid because it may prevent the analysis of the chemical composition and/or the physical properties of the formation fluid.

In some example subterranean formations such as heavy oil or bitumen formations, carbon dioxide and hydrogen are not typically present in formation fluids (e.g., not a pristine component of formation fluid) and, therefore, if either hydrogen and/or carbon dioxide are present in a formation fluid sample after hydrogen and/or carbon dioxide have been injected into the formation via the injector 309, the fluid analyzer 325 and/or any other testing device(s) will recognize that these components or elements were not previously present in the formation fluid. The testing device(s) may be positioned within the wireline tool 200 (FIG. 2) and/or may be positioned up-hole (e.g., in a laboratory, etc.).

Furthermore, though the examples described below describe chemical reactions using certain elements and/or components, any chemical reaction using any suitable element and/or components may be used to produce at least a gaseous diluent and heat.

$$H_2O_2(l) + H_2O(l) + CH_3OH(l) \xrightarrow{Pt/Al_2O_3, T \approx 800K} CO_2(g) + 2H_2(g) + 2H_2O(g), \quad \Delta_r H_m^0 = -653\ kJ \cdot mol^{-1} \qquad \text{Equation 3}$$

$$H_2O_2(l) + H_2O(l) + CH_3OH(l) \xrightarrow{Pt/Al_2O_3, T \approx 800K} \frac{1}{4}O_2(g) + \frac{1}{2}CO(g) + \frac{1}{2}CO_2(g) + 2H_2(g) + 2H_2O(g), \quad \Delta_r H_m^0 = -511\ kJ \cdot mol^{-1} \qquad \text{Equation 4}$$

The chemical reactions represented in Equations 3 and 4 produce gaseous products and relatively large standard molar enthalpies of reaction (e.g., heat content) which are represented by $\Delta_{l+g}H_m^{\odot}$. The chemical reaction illustrated in Equation 3, provides a total energy of about 48 MJ (i.e., mega joules) with a volume of about 1.5 $dm^3$ (i.e., cubic decimeter) comprising 50% water (i.e., $H_2O$) and 50% hydrogen peroxide (i.e., $H_2O_2$) and 0.8 $dm^3$ methanol (i.e., $CH_3OH$). In some examples, the components and/or elements represented in Equations 2 and 3 are exposed to a catalyst such as, for example, a platinum material supported on aluminum oxide (i.e., $Al_2O_3$) or any other suitable catalyst that may initiate or increase the rate at which the chemical reaction occurs. The reactor 312 may be provided with the catalyst. In other examples, the catalyst is positioned in any other suitable position such as, for example, within the sampling probe 304.

Any other suitable chemical compound or element may be substituted for any or all of the components or elements illustrated in Equations 3 and 4 such as, for example, methanol (i.e., $CH_3OH$) may be substituted at least in part by ethanol (e.g., $CH_3CH_2OH$), and/or a carbohydrate such as sugar, etc.

The standard molar enthalpies of Equations 3 and 4 were obtained from the enthalpy of liquid to gas transition, which is represented by $\Delta_{l+g}H_m^{\odot}$ for water and illustrated in Equation 5 below.

$$H_2O(l) = H_2O(g), \Delta_{l+g}H_m^{\odot} = 40.65\ kJ \cdot mol^{-1} \qquad \text{Equation 5}$$

The standard molar enthalpies and the enthalpy of liquid to gas transition were combined with the standard molar enthalpy of formation, which is represented by $\Delta_f H_m^{\odot}$ and illustrated in Equations 6, 7, 8, 9, and 10 below.

$$H_2(g) + O_2(g) = H_2O_2(l), \quad \Delta_f H_m^{\odot} = -188.8\ kJ \cdot mol^{-1} \qquad \text{Equation 6}$$

$$H_2(g) + \frac{1}{2}O_2(g) = H_2O(l), \quad \Delta_f H_m^{\odot} = -287.6\ kJ \cdot mol^{-1} \qquad \text{Equation 7}$$

$$C(s) + 2H_2(g) + \frac{1}{2}O_2(g) = CH_3OH(l), \quad \Delta_f H_m^{\odot} = 240.2\ kJ \cdot mol^{-1} \qquad \text{Equation 8}$$

$$C(s) + \frac{1}{2}O_2(g) = CO(g), \quad \Delta_f H_m^{\odot} = -111.2\ kJ \cdot mol^{-1} \qquad \text{Equation 9}$$

$$C(s) + O_2(g) = CO_2(g), \quad \Delta_f H_m^{\odot} = -395.9\ kJ \cdot mol^{-1} \qquad \text{Equation 10}$$

An alternative chemical reaction that may have a lower enthalpy of reaction is illustrated below in Equation 11. Equation 11 illustrates an example chemical reaction in which hydrogen peroxide ($H_2O_2$) is decomposed to create water (e.g., steam) and oxygen ($O_2$). In some examples, the hydrogen peroxide is exposed to a catalyst such as, for example, a silver (i.e., Ag) screen and/or a platinum (i.e., Pt) screen) to initiate the decomposition (e.g., the chemical reaction).

$$H_2O_2(l) = H_2O(l) + \frac{1}{2}O_2(g), \quad \Delta_r H_m^{\odot} = -98.2\ kJ \cdot mol^{-1} \qquad \text{Equation 11}$$

The product(s) of the chemical reaction proceed through the scrubber 314 from the reactor 312. The scrubber 314 removes unwanted components from the product of the chemical reaction. As illustrated above, the chemical reactions represented by Equations 3 and 4 produce carbon dioxide ($CO_2$). Carbon dioxide may be dissolvable within a formation fluid without causing precipitation of asphaltenes. However, precipitation of asphaltenes may occur after a certain amount of carbon dioxide is dissolved within the formation fluid. Precipitation of asphaltenes is associated with solid particles forming within the formation fluid that may clog the formation, slow the rate at which a fluid sample is obtained, decrease the rate at which the mobility of the formation fluid increases, and/or alters (e.g., chemically alters) the formation fluid sampled following an exposure to the products of the chemical reaction. Having the product of chemical reaction pass through the scrubber 314 may substantially eliminate the presence of carbon dioxide and/or any other unwanted elements or components from the product of the chemical reaction to prevent its introduction into the formation fluid and, thus, substantially prevent precipitation of asphaltenes. In other examples, the example apparatus 300 may not be provided with the scrubber 314.

The injector 309 injects (e.g., moves) the product of the chemical reaction from the scrubber 314 into the formation F (FIG. 2). The injector 309 may be provided with any other suitable device to assist in injecting the product of the chemical reaction into the formation F (FIG. 2). The reactant stores 310 and 311, the reactor 312 and the injector 309 are fluidly coupled to the sampling probe 304 via a valve 332, which has a first selectable outlet 334 that is fluidly coupled to the scrubber 314 and a second selectable outlet 336 that is fluidly coupled to the fluid analyzer 325. Although the injector 309 and the first and second reactant stores 310 and 311 are shown as being separate from the reactor 312 and the scrubber 314, in some examples, the reactor 312 and/or the scrubber 314 may be in or relatively closer (e.g., in engagement with) the injector 309 as discussed in more detail below in connection with FIG. 5.

In another example implementation (not shown), the example apparatus 300 may be provided with a plurality of sampling probes (not shown) as described in U.S. Patent Application Publication No. 2008/0066536 and U.S. Patent Application Publication No. 2008/0066904, both of which are assigned to the assignee of the present patent and incorporated herein by reference in their entireties. In this example, at least one of the sampling probes may inject and/or expose the product of a chemical reaction to the formation F (FIG. 2), and at least one other sampling probe may obtain a sample of the formation fluid from the formation F (FIG. 2).

To measure properties and/or characteristics of the formation fluid, the example apparatus 300 is provided with a formation evaluation sensor 337. The formation evaluation sensor 337 may monitor a viscosity of the fluid in the subsurface formation before, during and/or after the injector 309 has injected the product of the chemical reaction into the formation F. The formation evaluation sensor 337 may identify a change in the viscosity of the formation fluid such as, for example, the formation evaluation sensor 337 may identify when the formation fluid has become sufficiently mobile to enable sampling of the formation fluid. For example, the formation evaluation sensor 337 may be provided with a NMR tool (not shown) to make NMR measurements and to at least partially determine characteristics of the formation fluid associated with the viscosity of the formation fluid within the formation before, during and/or after the product of the chemical reaction is exposed to the formation F.

Once the mobility of the formation fluid has increased by decreasing the viscosity of the formation fluid, a sufficient amount of the product has been exposed to the formation F, and/or a specified time as lapsed, the injector 309 stops injecting the product of the chemical reaction into the formation F and the third pump 320 draws a sample of the formation fluid (e.g., from the formation F) through the sample flowlines 306 and 318, to the fluid analyzer 325. The formation fluid may be any type of formation fluid such as, for example, a wellbore fluid, a fluid extracted from subsurface formation, a heavy oil, a bitumen, a gas condensate, a hydrocarbon fluid, a typical crude oil, methane hydrate or a drilling fluid. In some examples, the formation fluid may be an oil-based drilling fluid or a filtrate of an oil-based drilling fluid mixed with a formation hydrocarbon. The example apparatus 300 of FIG. 3 may be configured to use the flowline 318 to enable fluid samples to be analyzed by the fluid analyzer 325 to determine a characteristic of the formation fluid and/or to enable fluid samples to be stored in the fluid store 326 or expelled into the wellbore 202 (FIG. 2). The fluid analyzer 325 may be used to determine a characteristic of the fluid sample such as, for example, a chemical composition, a density, a gas-oil ratio, a viscosity, a thermal conductivity, and/or a heat capacity. Although not shown, the fluid analyzer 325 may be provided with one or more suitable sensor(s) including, for example, a nuclear magnetic resonance (NMR) sensor, a density sensor, a capacitance sensor, a volume sensor, a spectrometer, a resistivity measurement device (e.g., an ohmmeter), etc. to measure fluid characteristics.

To control the hydraulic system 302, the reactor 312, the scrubber 314, the injector 309, the third pump 320, the valves 322 and 332, the formation evaluation sensor 337 and the fluid analyzer 325, the example apparatus 300 is provided with a downhole control and processing system 338. Although not shown, the downhole control and processing system 338 may include a processor, one or more memories, and a communication interface (e.g., a modem). The communication interface of the downhole control and processing system 338 may be communicatively coupled to a surface system (e.g., the electronics and processing system 206 of FIG. 2) via wires or lines 340 (FIG. 3), and/or the cable 204 (FIG. 2) to communicate reactant data, chemical reaction data, analysis data, and/or receive control data. The wires or lines 340 may include a databus (e.g., carrying digital information and/or analog information), electrical power lines, etc. and may be implemented using a single conductor or multiple conductors.

In operation, the downhole control and processing system 338 may be used to control the hydraulic system 302 to cause the sampling probe 304 to engage the formation F (FIG. 2). The downhole control and processing system 338 may control the injector 309 to move the reactants and/or the product of the chemical reaction through the flowlines 306, 313 and 315, the reactor 312, and the scrubber 314. The downhole control and processing system 338 may control when the formation evaluation sensor 337 monitors (e.g., measures, tests) the viscosity of the formation fluid such as, for example, before, during, or after the injector 309 has injected the product of the chemical reaction into the formation F (FIG. 2). Additionally, the formation evaluation sensor 337 communicates to the downhole control and processing system 338 when the formation evaluation sensor 337 identifies that the viscosity and/or the formation fluid has become sufficiently mobile to enable sampling of the formation fluid. Additionally, the downhole control and processing system 338 may also control the third pump 320 to draw formation fluid through the flowlines 306 and 318 and the fluid analyzer 325.

Figure 4:
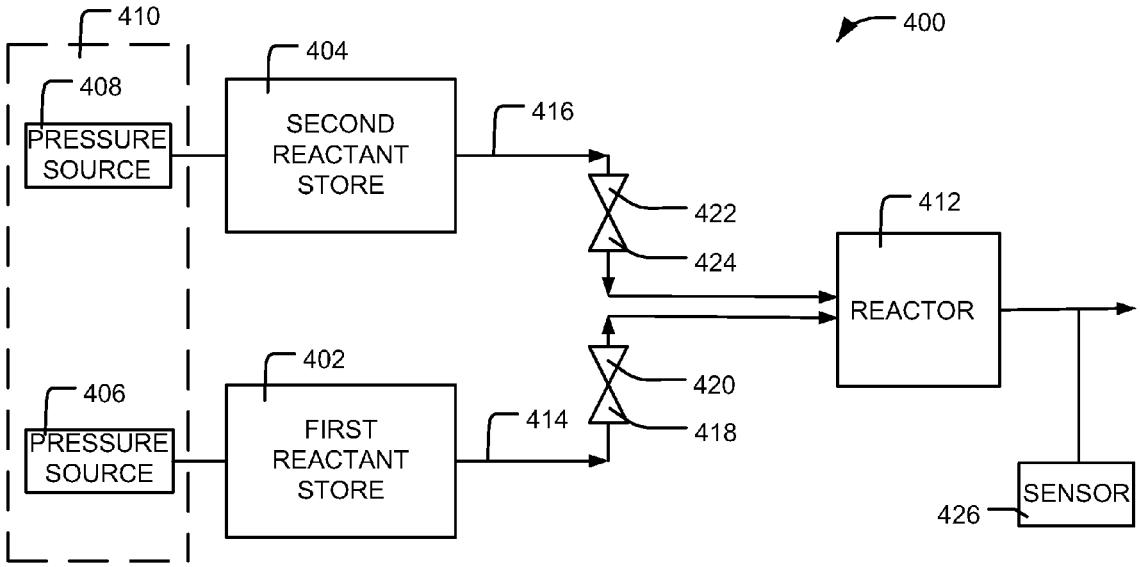
FIG. 4 depicts a block diagram of an example apparatus that may be implemented in connection with the example apparatus of FIG. 3.

Now turning to FIG. 4, a detailed block diagram of an example apparatus 400 that includes an example first reactant store or chamber 402 that retains a first reactant, a second reactant store or chamber 404 that retains the second reactant, which may be substantially the same or different from the first reactant. Additionally, the example apparatus is provide with a first pressure source 406 and a second pressure source 408, that may be the same or different from the first pressure source 406. The first and second pressure sources 406 and 408, which may be implemented as pumps, form an injector 410, which may be used to implement the injector 309 of FIG. 3. The example apparatus 400 also includes an example reactor 412, which may be used to implement the reactor 312 of FIG. 3. The first reactant store or chamber 402 and the second reactant store or chamber 404 may be fluidly coupled to the reactor 412 via flowlines 414 and 416, which are represented in FIG. 3 by the flowlines 306, 313 and 315. A metering valve 418 (e.g. a needle valve) positioned between the first reactant store or chamber 402 and the reactor 412 has a first selectable outlet 420 that is fluidly coupled to the reactor 412. A metering valve 422 positioned between the second reactant store or chamber 404 and the reactor 412 has a first selectable outlet 424 that is fluidly coupled to the reactor 412. A sensor 426 is positioned adjacent the reactor 412 and may monitor a characteristic of the product of the chemical reaction such as the temperature. If the temperature of the product of the chemical reaction is too low or too high as compared to a desired temperature, the flow rate of the reactant(s) from the first and/or second reactant stores or chambers 402 and 404 may change to substantially achieve the desired temperature of the product of the chemical reaction.

The first and second pressure sources 406 and 408 may be used to provide a sufficient pressure level to inject the reactants or a product of a chemical reaction between the reactants into a formation. The first pressure source 406 and/or the second pressure source 408 pumps or moves at least a part of the different reactants through the flowlines 414 and 416 to the reactor 412. In some examples, the quantity and/or rate at which the first reactant is moved from the first reactant store or chamber 402 to the reactor 412 is substantially the same as the quantity and/or rate at which the second reactant is moved from the second reactant store or chamber 404 to the reactor 412. In other examples, the amount and/or rate (e.g., speed) at which the first reactant is moved from the first reactant store or chamber 402 to the reactor 412 is different from the quantity and/or rate at which the second reactant is moved from the second reactant store or chamber 404 to the reactor 412. Specifically, the quantity and/or rate at which the first and second reactants move from the first and second reactant stores or chambers 402 and 404 through the flowlines 414 and 416 to the reactor 412 is associated with a stoichiometric ratio. For example, 2 liters (L) of hydrogen peroxide ($H_2O_2$) may be moved from the first reactant store or chamber 40 to the reactor 412 and 1 liter (L) of methanol ($CH_3OH$) may be moved from the second reactant store or chamber 404 to the reactor 412. In other examples, only one reactant is used in a chemical reaction such as, for example, the decomposition of hydrogen peroxide. In some examples, some or all of the reactants may be in a substantially liquid state. In other examples, some or all of the reactants may be in a substantially gaseous state or any other suitable state.

As described above, the reactor 412 receives the reactant(s) from the first reactant store or chamber 402 and/or the second reactant store or chamber 404 and may be used to mix the reactants together and expose the reactants to a catalyst that may be positioned within the reactor 412. In other examples, the first reactant and the second reactant are mixed in the reactor 412 and then exposed to a catalyst that is in or relatively close to the sampling probe 304 (FIG. 3) and, thus, the first reactant and the second reactant are exposed to the catalyst substantially adjacent to the formation. In still other examples, the catalyst is positioned in a heat pipe 514 (FIG. 5) or injection probe. For example, if the heat pipe 514 (FIG. 5) is provided with the catalyst and positioned, for example, at least partially within the formation F (FIG. 2) (e.g., up to 1 m), the first and second reactants may be exposed to the catalyst at least partially within the formation F.

The positioning of the flowlines 414 and 416 relative to the reactor 412 may be at least in part to substantially delay the first reactant from the first reactant store or chamber 402 from reacting with the second reactant from the second reactant store or chamber 404 and, thus, may substantially delay the initiation of the chemical reaction until the first and second reactants are adjacent to or within the formation F (FIG. 2) or closer to the formation F (FIG. 2). Delaying the chemical reaction may allow for substantially more of the product(s) of the chemical reaction (e.g., heat and/or a gaseous diluent) to be injected and/or exposed to the formation F and, thus, may increase the rate at which a characteristic (e.g., mobility) of the formation fluid changes and the rate at which a formation sample may be obtained. Additionally, delaying the chemical reaction until the reactants and/or the product of the chemical reaction is about to be exposed and/or injected into the formation F (FIG. 2) minimizes the exposure that components of the example apparatus 300 and 400 of FIGS. 3 and 4 or an example apparatus 500 of FIG. 5 have to the product of the chemical reaction and, thus, may extend the useful life and/or reduce wear and tear on the example apparatus 300, 400, and 500.

Figure 5:
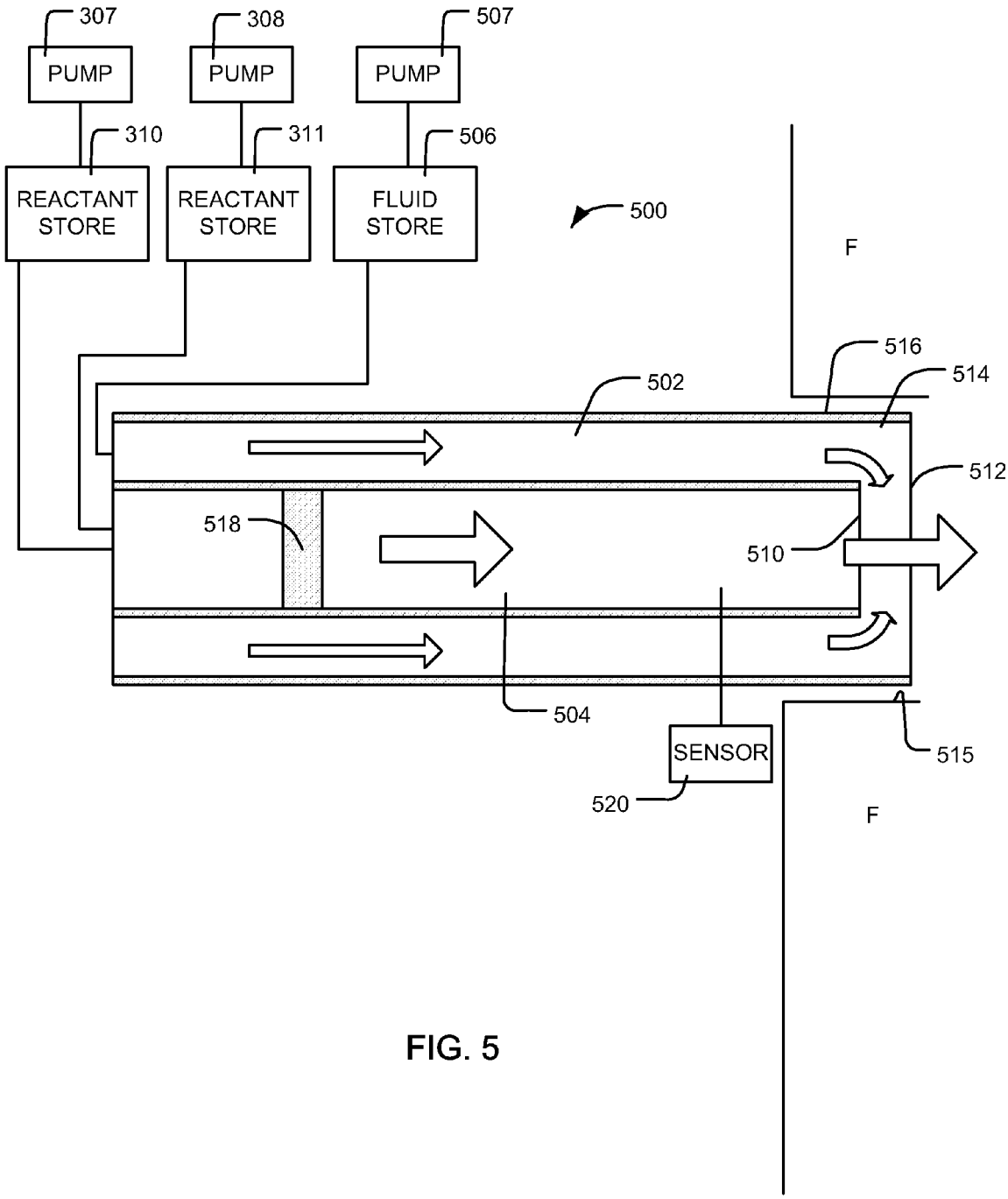
FIG. 5 depicts a block diagram of another example apparatus that may be implemented in connection with the example apparatus of FIG. 3.

Now turning to FIG. 5, a detailed block diagram of the example apparatus 500 (e.g., an injector unit 500) that may be used to implement the sampling probe 304, the reactor 312 and the injector 309 of FIG. 3. The example apparatus 500 includes an example first flow channel 502 and an example second flow channel 504. The second flow channel 504 is fluidly coupled to the first and second reactant stores 310 and 311 and the first flow channel 502 is fluidly coupled to a fluid store 506. The fluid store 506 may store any suitable fluid and/or heat transfer fluid such as, for example, water or previously extracted formation fluid that may be used to convey at least part of the heat from the chemical reaction to the formation F. The heat transfer fluid may be moved and/or pumped to the first flow channel 502 via a pump 507. The first reactant and/or the second reactant flows from the reactant stores 310 and 311 through the second flow channel 504 toward an opening 510 defined by the second flow channel 504 at a first flow rate and the fluid from the fluid store 506 flows from the fluid store 506 through the first flow channel 502 toward an opening 512 defined by the first flow channel 502 at a second flow rate. Alternatively, the apparatus 500 may not be provided with the fluid store 506 and the first reactant store 310 may be fluidly coupled to the first flow channel 502 and the second reactant store 311 may be fluidly coupled to the second flow channel 504. The rate at which the first reactant and the second reactant flow through the second flow channel 504 and/or the first and second flow channels 502 and 504 may be associated with a stoichiometric ratio.

Once the first and second reactants enter the second flow channel 504, the second reactant at least partially mixes with the first reactant and initiates the chemical reaction. The chemical reaction produces at least heat and a gaseous diluent. As the first and second reactants flow through the second flow channel 504, a heat transfer fluid flows through the first flow channel 502 and at least part of the heat from chemical reaction radiates and/or conducts through the second flow channel 504 to the heat transfer fluid and, thus, the temperature of the heat transfer fluid increases. Along with the first and second reactants, the heat transfer fluid exits the opening 512 into the formation F (FIG. 2). Alternatively, once the second reactant exits the opening 510, the second reactant at least partially mixes with the first reactant before both the first and second reactants exit the opening 512 defined by the first flow channel 502 into the formation F (FIG. 2). In this example, mixing the first reactant with the second reactant initiates a chemical reaction.

The first flow channel 502 is substantially concentric with the second flow channel 504. The position of the first flow channel 502 relative to the second flow channel 504 may substantially control when the first reactant contacts the second reactant and, thus, as discussed above, the initiation of the chemical reaction may be delayed until the first reactant and the second reactant are substantially adjacent to or within the formation F (FIG. 2).

The first flow channel 502 may be provided with the heat pipe 514 that may be partially inserted into a perforation 515 of the formation and may be used to implement the sampling probe 304 of FIG. 3. The perforation 515 may be formed via a tool (not shown) as described in U.S. Pat. No. 5,692,565 and U.S. Pat. No. 7,347,262 both of which are assigned to the assignee of the present patent and incorporated herein by reference in their entireties. In this example, the heat pipe 514 is a cylindrical sleeve that enables the product(s) of the chemical reaction to flow through the opening 512 and into the formation F (FIG. 2). Specifically, at least part of the gaseous diluent and heat from the exothermic chemical reaction flows through the opening 510 and into the formation F (FIG. 2). Additionally, at least part of the heat from the exothermic reaction radiates and/or is conducted through an exterior surface 516 of the heat pipe 514 and into the formation F (FIG. 2). The heat pipe 514 may be any suitable device and may be made of any suitable thermally conductive material that is able to withstand being in a downhole environment and exposed to the product of the chemical reaction.

The second flow channel 504 is provided with a catalyst 518 that at least partially contacts the first and second reactants as they flow through the second flow channel 504. The catalyst 518 may be in any suitable arrangement such as, for example, a grill arrangement, a lattice arrangement, a packed bed arrangement or a filter pack arrangement. The catalyst 518 may be in any other suitable position such as, for example, a position within the first flow channel 502 and the position of the catalyst 518 relative to the first and/or second reactants may be associated with delaying and/or changing when the chemical reaction occurs. In other examples, the first flow channel 502 may be in any other suitable position relative to the second flow channel 504, such as, for example, the first flow channel 502 may be substantially parallel to the second flow channel 504. A sensor 520 is at least partially positioned within the second flow channel 504 and may monitor a characteristic of the product of the chemical reaction such as the temperature. If the temperature of the product of the chemical reaction is too low or too high as compared to a desired temperature, the flow rate of the reactant(s) from the first and second reactant stores 310 and 311 may change to substantially achieve the desired temperature.

Figure 6:
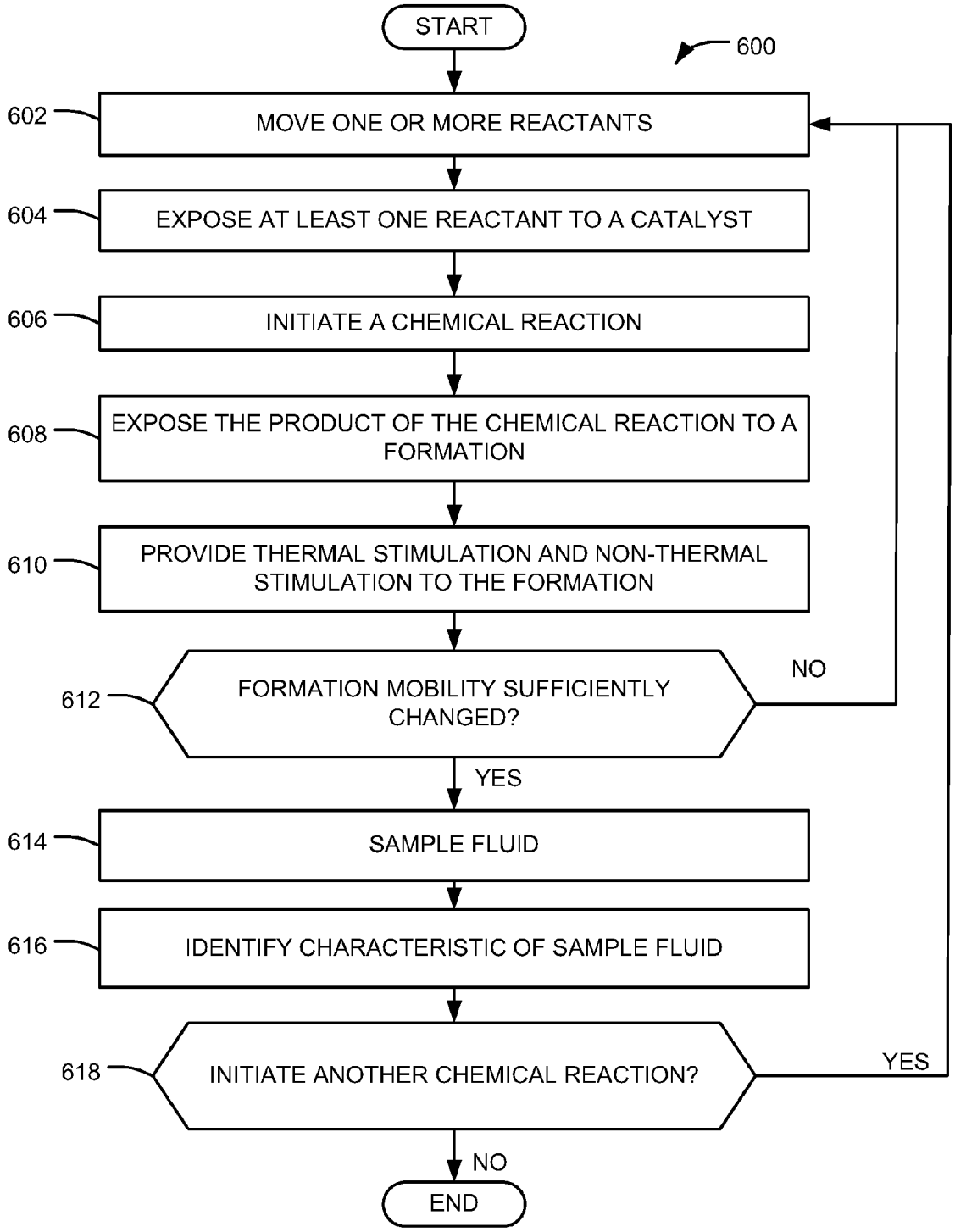
FIG. 6 depicts a flow diagram of an example method that may be used to change the mobility of a formation fluid and to extract and analyze formation fluid samples.

FIG. 6 is a flow diagram of an example method 600 that may be used to change the mobility of a fluid in a subsurface formation. The example method 600 of FIG. 6 may be used to implement the example formation tester 214 of FIG. 2, the example apparatus 300 of FIG. 3 and/or the examples apparatus 400 and 500 of FIGS. 4 and 5. In some examples, the flow diagram can be representative of machine (e.g., computer, processor, etc.) readable instructions and the example method of the flow diagram may be implemented entirely or in part by executing the machine readable instructions. Such machine readable instructions may be executed by the electronics and processing system 206 and/or the downhole control and processing system 338. In particular, a processor or any other suitable device to execute machine readable instructions may retrieve such instructions from a memory device (e.g., a random access memory (RAM), a read only memory (ROM), etc.) and execute those instructions. In some examples, one or more operations depicted in the flow diagram of FIG. 6 may be implemented manually.

While an example manner of implementing the example formation tester 214 of FIG. 2, the example apparatus 300 of FIG. 3 and/or the example apparatus 400 and 500 of FIGS. 4 and 5 has been illustrated in FIG. 6, one or more of the elements, methods and/or operations illustrated in FIG. 6 may be combined, divided, re-arranged, omitted, eliminated and/or implemented in any other way. Any of the operations of the example method described in FIG. 6 may be implemented by hardware, software, firmware and/or any combination of hardware, software and/or firmware, including, for example, by one or more circuit(s), programmable processor(s), application specific integrated circuit(s) (ASIC(s)), programmable logic device(s) (PLD(s)) and/or field programmable logic device(s) (FPLD(s)), etc. Further still, the example method of FIG. 6 may include one or more elements, processes and/or devices in addition to, or instead of, those illustrated in FIG. 6, and/or may include more than one of any or all of the illustrated elements, methods and devices.

Initially, one or more reactants that are stored in the first and/or second reactant stores 310 and 311 (FIG. 3) are moved (block 602) via the pumps 307 and 308 (FIG. 3) toward, for example, the reactor 312 (FIG. 3). In the example apparatus 400 of FIG. 4, the reactants flow from the first and second reactant stores or chambers 402 and 404 (FIG. 4) through the flowlines 414 and 416 (FIG. 4) toward the reactor 412 (FIG. 4). In the example apparatus 500 of FIG. 5, the reactants flow through the first flow channel 502 (FIG. 5) and/or the second flow channel 504 (FIG. 5). As discussed above, the first reactant and/or the second reactant may be exposed to a catalyst (block 604) before, during or after the first reactant has come into contact with the second reactant. A catalyst may substantially increase the rate at which a chemical reaction occurs and may not be substantially consumed by the chemical reaction.

To initiate a chemical reaction, the first reactant is exposed to the second reactant and/or the catalyst (block 606). The injector 309 (FIG. 3) moves the product(s) of the chemical reaction from the reactor 312 (FIG. 3) and/or the scrubber 314 (FIG. 3) and injects and/or exposes the product(s) of the chemical reaction to the formation F (FIG. 2) (block 608). In some examples, the sampling probe 304 (FIG. 3) and/or the injector unit 500 (FIG. 5) may be provided with the heat pipe 514 (FIG. 5) or any other means to efficiently conduct heat produced by the chemical reaction to the formation F (FIG. 2) and to convey a gaseous diluent produced by the chemical reaction into the formation F (FIG. 2).

As discussed above, heating the formation F (FIG. 2) and/or formation fluid to reduce the viscosity of a formation fluid is a thermal stimulation technique, and exposing and/or injecting a gaseous diluent into a formation fluid is a non-thermal stimulation technique. As illustrated by the equations above (i.e., Equations 3 through 12), the products of the example chemical reactions used by the example methods and apparatus described herein involves both heat and a gaseous diluent and, therefore, when the product of the chemical reaction is exposed and/or injected into the formation F the product of the chemical reaction provides both heat to increase the temperature of the formation (i.e., a thermal stimulation) and a gaseous diluent that is to be dissolved in the formation fluid (e.g., a non-thermal stimulation) to change the viscosity of the formation fluid (block 610).

The example method then determines if the formation mobility has sufficiently changed (e.g., the viscosity has decreased sufficiently) to enable sampling of the formation fluid (block 612). As described above, the example apparatus 300 (FIG. 3) may be provided with the formation evaluation sensor 337 (FIG. 3) to monitor changes in the formation fluid viscosity as the product of the chemical reaction is exposed to and/or injected into the formation F (FIG. 2). In this manner, the properties of the formation fluid may be evaluated during injection of the product of the chemical reaction into the formation F (FIG. 2) to, for example, determine when the mobility of the formation fluid has changed sufficiently to be sampled by the sampling probe 304 (FIG. 3) (block 612). In some implementations, formation fluid viscosity measurements may be used to control the amount of time and/or the rate at which the product of chemical reaction is exposed to the formation F (FIG. 2). If the formation mobility has sufficiently changed, the fluid is sampled (block 614). On the other hand, if it is determined that the formation mobility (e.g., formation fluid viscosity) has not changed sufficiently, control returns to block 602 and another chemical reaction is initiated as discussed above.

Once a sample is obtained, the fluid analyzer 325 (FIG. 3) determines or identifies a characteristic of the fluid sample (block 616). In some examples, the characteristic is a partial chemical composition, a density, a gas-oil ratio, a viscosity, an estimate of fluid mobility, a thermal conductivity, a heat capacity, a thermal diffusivity and/or a self diffusivity. The fluid analyzer 325 (FIG. 3) may be implemented using any suitable analyzer such as, for example, a spectrometer, a resistivity measurement device (e.g., ohmmeter), etc. Additionally, the downhole control and processing system 338 (FIG. 3) and/or the electronics and processing system 206 (FIG. 2) may be configured to store measurement data corresponding to the fluid sample.

The downhole control and processing system 338 then determines whether it should initiate another chemical reaction (block 618). For example, if the example apparatus 300 determines that another fluid sample is necessary and the downhole control and processing system 338 has not received an instruction or command to stop initiating another chemical reaction, the downhole control and processing system 338 may determine that it should initiate another chemical reaction. Otherwise, the example process of FIG. 6 is ended.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A subsurface formation fluid mobility changing apparatus, comprising:

a container configured to hold a reactant;

a reactor configured to initiate a chemical reaction with the reactant;

an injector configured to inject a product of the chemical reaction into a subsurface formation, wherein heat is produced and the product of the chemical reaction is a gaseous diluent, wherein the heat and the gaseous diluents are operable to change a mobility of a fluid in the formation;

a sampler configured to obtain a sample of the formation fluid; and an analyzer configured to analyze a characteristic of the sample, wherein the analyzer is positioned in a downhole tool; and a controller configured to control at least one of the reactor or the injector, wherein the apparatus is conveyed on a wireline into the subsurface formation.

2. The apparatus of claim 1 wherein the gaseous diluent is at least partially miscible in the formation fluid, and wherein the chemical reaction generates a gaseous solvent.

3. The apparatus of claim 1 wherein the reactor comprises a catalyst.

4. The apparatus of claim 1 further comprising a formation evaluation sensor configured to determine the change in the mobility of the formation fluid.

5. The apparatus of claim 1 further comprising a scrubber configured to substantially decrease at least one of carbon dioxide or another component from the product of the chemical reaction prior to injecting the product of the chemical reaction into the formation.

6. The apparatus of claim 1 wherein the reactant comprises an oxidizing agent.

7. The apparatus of claim 1 wherein the reactant comprises a fuel source.

8. The apparatus of claim 1 wherein the chemical reaction comprises decomposing the reactant.

9. The apparatus of claim 1 wherein the injector comprises a heat pipe configured to thermally conduct at least part of the heat from the product of the chemical reaction to the formation, and wherein the reactor and the injector form at least part of an injector unit that comprises a plurality of flow channels.

10. A method of changing a subsurface formation fluid mobility, comprising:

conveying a tool to a subsurface location on a wireline;

initiating a chemical reaction with the tool with one or more chemicals to produce heat and, wherein a product of the chemical reaction is a gaseous diluent;

exposing the product of the chemical reaction to the formation to change the mobility of a formation fluid; and obtaining a sample of the formation fluid after exposing the product of the chemical reaction to the formation wherein exposing the product of the chemical reaction to the formation comprises at least partially dissolving the gaseous diluent in the formation fluid.

11. A method of changing a subsurface formation fluid mobility, comprising:

conveying a tool to a subsurface location on a wireline;

initiating a chemical reaction with the tool with one or more chemicals to produce heat and, wherein a product of the chemical reaction is a gaseous diluent;

exposing the product of the chemical reaction to the formation to change the mobility of a formation fluid; and obtaining a sample of the formation fluid after exposing the product of the chemical reaction to the formation wherein initiating the chemical reaction comprises exposing the one or more chemicals to a catalyst.

12. A method of changing a subsurface formation fluid mobility, comprising:

conveying a tool to a subsurface location on a wireline;

initiating a chemical reaction with the tool with one or more chemicals to produce heat and, wherein a product of the chemical reaction is a gaseous diluent;

exposing the product of the chemical reaction to the formation to change the mobility of a formation fluid; and obtaining a sample of the formation fluid after exposing the product of the chemical reaction to the formation and further comprising substantially decreasing an amount of carbon dioxide in the product of the chemical reaction prior to exposing the product of the chemical reaction to the formation.

* * * * *